US007181902B2

(12) United States Patent
Naik

(10) Patent No.: US 7,181,902 B2
(45) Date of Patent: Feb. 27, 2007

(54) COORDINATED ENGINE CONTROL FOR LEAN NOX TRAP REGENERATION

(75) Inventor: Sanjeev M. Naik, Troy, MI (US)

(73) Assignee: General Motors Corporation, Detroit, MI (US)

( * ) Notice: Subject to any disclaimer, the term of this patent is extended or adjusted under 35 U.S.C. 154(b) by 115 days.

(21) Appl. No.: 10/812,584

(22) Filed: Mar. 30, 2004

(65) Prior Publication Data

US 2005/0217240 A1 Oct. 6, 2005

(51) Int. Cl.
*F01N 3/00* (2006.01)

(52) U.S. Cl. ..... 60/274; 60/278; 60/286; 60/295; 60/297; 123/295; 123/305

(58) Field of Classification Search ..... 60/274, 60/285, 286, 295, 297, 278; 123/295, 299, 123/305, 430
See application file for complete search history.

(56) References Cited

U.S. PATENT DOCUMENTS 5,437,153 A 8/1995 Takeshima et al.
6,041,592 A 3/2000 Huynh et al.
6,065,443 A * 5/2000 Mizuno et al. ..... 123/295
6,079,204 A 6/2000 Sun et al.
6,109,025 A 8/2000 Murata et al.
6,148,612 A 11/2000 Yamashita et al.
6,223,525 B1 5/2001 Takanohashi
6,237,329 B1 5/2001 Mizuno
6,244,047 B1 6/2001 Brehob et al.
6,253,546 B1 7/2001 Sun et al.
6,293,092 B1 9/2001 Ament et al.
6,370,868 B1 4/2002 Kolmanovsky et al.
6,539,709 B2 * 4/2003 Kubo et al. ..... 60/301
6,609,364 B2 * 8/2003 Litorell et al. ..... 60/274
6,620,392 B2 * 9/2003 Okamoto et al. ..... 423/213.5
6,708,668 B2 * 3/2004 Yoshida et al. ..... 123/295
6,782,694 B2 * 8/2004 Nakagawa et al. ..... 60/285

* cited by examiner

*Primary Examiner*—Binh Q. Tran
(74) *Attorney, Agent, or Firm*—Kathryn A. Marra

(57) ABSTRACT

A method for controlling a direct-injection gasoline engine during regeneration of a lean NOx trap disposed in an exhaust path of the engine includes determining the current air-fuel ratio and comparing the current air-fuel ratio to a lean limit air-fuel ratio. Transitions from lean stratified engine operation to rich homogenous engine operation are delayed until the current air-fuel ratio reaches the lean limit air-fuel ratio.

27 Claims, 6 Drawing Sheets

COORDINATED ENGINE CONTROL FOR LEAN NOX TRAP REGENERATION

TECHNICAL FIELD

The present invention relates to control of an internal combustion engine and more particularly relates to a system and method for coordinated control of direct-injection gasoline engine operation during lean NOx trap regeneration events.

BACKGROUND OF THE INVENTION

It is known in the art relating to internal combustion engines that by operating an engine with a less than stoichiometric (lean) mixture of fuel and air, efficiency of the engine is improved. This means that for a given amount of work performed by the engine, less fuel will be consumed, resulting in improved fuel efficiency. It is also well known that reduction of NOx emissions when the fuel rate is lean has been difficult to achieve, resulting in an almost universal use of stoichiometric operation for exhaust control of automotive engines. By operating an engine with a stoichiometric mixture of fuel and air, fuel efficiency is good and NOx emission levels are reduced by over 90% once the vehicle catalyst reaches operating temperatures.

Recent developments in catalysts and engine control technologies have allowed lean operation of the engine, resulting in improved fuel efficiency and acceptable levels of NOx emissions. One such development is a NOx adsorber (also termed a "lean NOx trap" or "LNT"), which stores NOx emissions during fuel lean operations and allows release of the stored NOx during fuel rich conditions with conventional three-way catalysis to nitrogen and water. The adsorber has limited storage capacity and must be regenerated with a fuel rich reducing "pulse" as it nears capacity. It is desirable to control the efficiency of the regeneration event of the adsorber to provide optimum emission control and minimum fuel consumption. It is further desirable to control the efficiency of the regeneration event of the adsorber to provide optimum emission control and minimum fuel consumption while at the same time minimizing or eliminating altogether any adverse impact on driveability. Various strategies have been proposed.

Commonly assigned U.S. Pat. No. 6,293,092 to Ament et al. entitled "NOx adsorber system regeneration fuel control" discloses a method for controlling regeneration fuel supplied to an internal combustion engine operating with a lean fuel-air mixture during sequential rich mixture regeneration events of a NOx adsorber in which NOx emissions collected by the adsorber are purged to provide optimum emissions control and minimum fuel consumption. The method monitors the exhaust gases flowing out of the adsorber during the regeneration event to detect when the fuel-air mixture to the engine is within an excessively lean or rich range. When the sensed exhaust gases contain an excessively lean fuel-air mixture, fuel is increased to the engine. Fuel is decreased when the sensed exhaust gases contain an excessively rich fuel-air mixture. The fuel can be increased or decreased by adjusting the duration or fuel rate of the regeneration event. U.S. Pat. No. 6,293,092 is hereby incorporated by reference.

In the art related to spark-ignition direct-injection (SIDI) engines, it is known to operate the engine in a stratified charge mode (very lean operation) in a lower range of engine output and in a homogeneous mode (less lean, stoichiometric, or rich of stoichiometric operation) in a higher range of engine power output with an intermediate zone wherein the cylinders operate in a combination of stratified charge and homogeneous charge combustion. In the stratified charge mode, the fuel is injected during the piston compression stroke (late injection), preferably into a piston bowl from which it is directed to a spark plug for ignition near the end of the compression stroke. The combustion chambers contain stratified layers of different air-fuel mixtures. The stratified mode generally includes strata containing a stoichiometric or rich air-fuel mixture nearer the spark plug with lower strata containing progressively leaner air-fuel mixtures. In the homogeneous charge mode, fuel is injected directly into each cylinder during its intake stroke (early injection) and is allowed to mix with the air charge entering the cylinder to form a homogeneous charge, which is conventionally ignited near the end of the compression stroke. The homogenous mode generally includes an air-fuel mixture that is stoichiometric, lean of stoichiometric or rich of stoichiometric.

Typically, there is a first range of air-fuel ratios within which stable combustion can be achieved in the stratified charge mode, such as between 25:1 and 40:1, and a second range in which stable combustion can be achieved in the homogeneous mode, such as between 12:1 and 20:1. Therefore, there is typically a significant gap between the leanest air-fuel ratio of the homogenous mode (in this example 20) and the richest air-fuel ratio of the stratified mode (in this example 25). This gap poses a number of challenges in selecting an appropriate operating mode and controlling the engine during transitions between operating modes. For example, careful control of engine operation is necessary to deliver the demanded torque without adversely affecting driveability when switching from the stratified to the homogenous mode or vice versa.

It is known in the art to coordinate valve timing during mode transitions to reduce engine torque variations. Methods to control individual engine variables during normal, single-mode operation as a lean NOx trap regeneration engine control strategy have also been proposed. But control of individual engine parameters can result in unacceptably rough operation. Transient control of fuel injection timing similar to other variables has also been proposed. But this can produce oscillatory behavior resulting from engine misfire.

Commonly assigned co-pending U.S. patent application Ser. No. 10/812,466 filed Mar, 30, 2004, the disclosure of which is hereby incorporated by reference herein in its entirety, describes a method to control a direct-injection gasoline engine during LNT regeneration events thereby improving driveability by adapting fueling to account for pumping losses resulting from higher throttling at homogeneous operation. Further, commonly assigned co-pending U.S. patent application Ser. No. 10/812,467 filed Mar. 30, 2004 also directed to a control strategy for lean NOx trap regeneration whereby the number of regeneration events carried out when a lean burn SIDI engine is otherwise running in a stratified modeare minimized, is hereby incorporated by reference herein in its entirety. However, lean NOx trap regenerations are still required under some stratified mode operating conditions and there is usually potential for undesirable degraded driveability during the occurrence of such regeneration events.

Therefore, there remains a need in the art for further advances in the control of engine operation during lean NOx trap regeneration. There further remains a need in the art for methods providing comprehensive coordinated control of engine operation during mode transitions associated with LNT regeneration that enable LNT regeneration to occur without adversely impacting driveability or NOx emissions at the tailpipe, particularly for mixed mode spark-ignition direct-injection (SIDI) engines.

SUMMARY OF THE INVENTION

The present invention applies to all direct-injection gasoline engines. The invention enables direct-injection gasoline engine powered vehicles to have good driveability while meeting stringent emissions targets (especially for NOx) and minimally impacting the fuel economy benefits of such powertrains. The engine control system comprises torque based engine controls wherein the system is responsive to desired torque inferred from driver input.

Lean burn SIDI engines periodically require regeneration of NOx traps. There is usually an associated consequence of degraded driveability during the occurrence of such regeneration events. The present invention improves driveability through coordinating engine control during such events, particularly with respect to equivalence ratio considerations. The present invention includes a method for further improving driveability by delaying transitions to homogeneous operation from stratified operation until the current air-fuel ratio reaches at least a lean limit air-fuel ratio whereat stable engine operation can be maintained.

During regeneration events, a direct-injection gasoline engine transitions from lean stratified operation to rich homogeneous operation. In accordance with the present invention, upon initiation of a lean NOx trap regeneration event, the current air-fuel ratio is determined and compared to a lean limit air-fuel ratio. Immediate transition from lean stratified engine operation to rich homogenous engine operation is forestalled until the determined air-fuel ratio reaches the lean limit air-fuel ratio.

The invention is implemented in a system including means for determining a current air-fuel ratio and comparing the current air-fuel ratio to a lean limit air-fuel ratio upon initiation of a lean NOx trap regeneration event. Means for delaying the transition from lean stratified engine operation to rich homogeneous engine operation until the current air-fuel ratio reaches the lean limit air-fuel ratio are also provided. Finally, means for initiating transition from lean stratified engine operation to rich homogeneous engine operation when the current air-fuel ratio reaches the lean limit air-fuel ratio are also provided.

An engine controller includes a storage medium having a computer program encoded therein for effecting coordinated control of engine operation and regeneration of a lean NOx trap disposed in an exhaust path of a direct-injection gasoline engine. The program includes code for carrying out the method of the invention including code for comparing a current air-fuel ratio to a lean limit air-fuel ratio upon initiation of a lean NOx trap regeneration event, code for delaying transition from lean stratified engine operation to rich homogeneous engine operation until the current air-fuel ratio reaches the lean limit air-fuel ratio, and code for initiating transition from lean stratified engine operation to rich homogeneous engine operation when the current air-fuel ratio reaches the lean limit air-fuel ratio.

Advantageously, by delaying the switch of fuel injection timing to early intake stroke until the equivalence ratio (that is, stoichiometric ratio/actual air-fuel ratio) reaches a predefined limit (for acceptable stability), the invention prevents the problem of unacceptably high combustion variability (as indicated by high COV of IMEP).

These and other features and advantages of the invention will be more fully understood from the following description of certain specific embodiments of the invention taken together with the accompanying drawings.

BRIEF DESCRIPTION OF THE DRAWINGS

Referring now to the drawings, which are meant to be exemplary, not limiting, and wherein like elements are numbered alike in the several Figures.

DESCRIPTION OF THE PREFERRED EMBODIMENT

Figure 1:
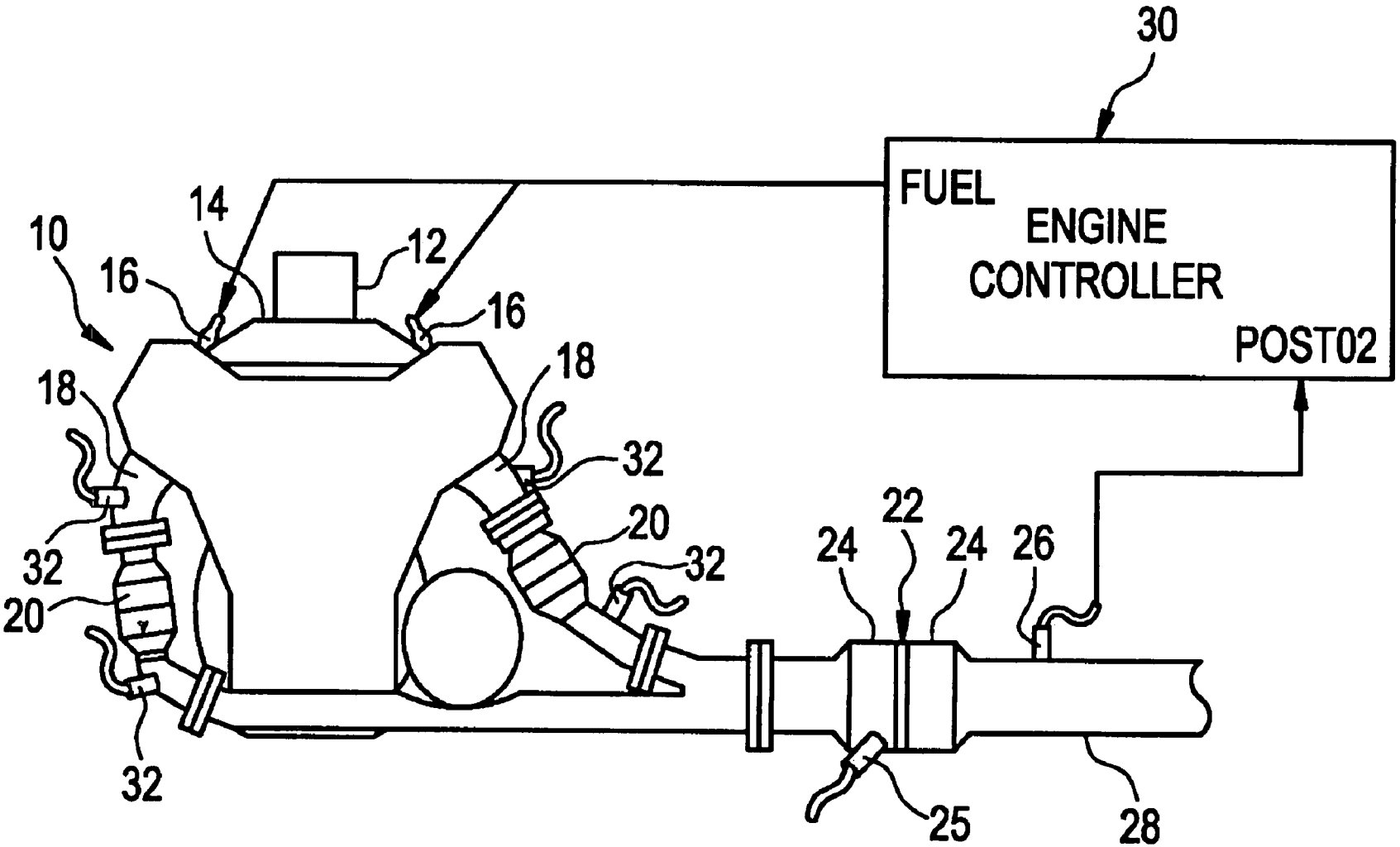
FIG. 1 is a block diagram showing generally means for carrying out the engine control strategy of the invention including a SIDI engine and engine control hardware.

Turning now to FIG. 1, a block diagram showing one possible embodiment of a system for carrying out the present invention includes a spark-ignition direct-injection engine 10 having an air intake 12 for admitting a flow of air into the engine 10 through intake manifold 14 by control of air throttle valves (not shown). Electronically-controlled fuel injectors 16 are disposed in the engine 10 for metering fuel thereto. The air-fuel mixtures are then burned in engine cylinders (not shown).

Exhaust gases produced in the engine cylinder combustion process flow out of the engine cylinders and through one or more exhaust gas conduits 18. A catalytic device such as a three-way converter 20 is connected to the exhaust gas conduit 18 to treat or clean the exhaust gases. From the catalytic device 20, the exhaust gases pass through a lean NOx trap (LNT) 22 including two elements 24 and, optionally, a temperature sensor 25 (temperature sensor 25 is not required if code is employed to estimate the LNT temperature). An air-fuel ratio sensor 26, such as a post-LNT wide range sensor or a conventional switching-type $O_2$ sensor 32, is disposed within the tailpipe 28 for monitoring the concentration of available oxygen in the exhaust gases and providing an output voltage signal $POSTO_2$ which is received and analyzed by an engine controller 30. The controller 30 includes ROM, RAM and CPU and includes a software routine 200 (described in FIG. 2) for performing the method of the present invention. The controller 30 controls fuel injectors 16, which inject fuel into their associated cylinders (not shown) in precise quantities and timing as determined by the controller 30. The controller 30 transmits a fuel injector signal to the fuel injectors 16 to maintain an air-fuel ratio determined by the controller including fuel, air, air-fuel ratio, exhaust gas recirculation (EGR), spark, swirl control valve, and fuel injection timing in accordance with the present control strategy. Additional sensors (not shown) provide other information about engine performance to the controller 30, such as crankshaft position, angular velocity, throttle and air temperature. Additionally, other oxygen sensors 32 variously placed may provide additional control information. The information from these sensors is used by the controller 30 to control engine operation. In a preferred embodiment, invention includes a method for controlling an engine wherein control of the engine torque is determined by driver demand, a system including means for controlling engine torque based upon driver demand, and a computer program including code for controlling engine torque based upon driver demand.

Figure 2:
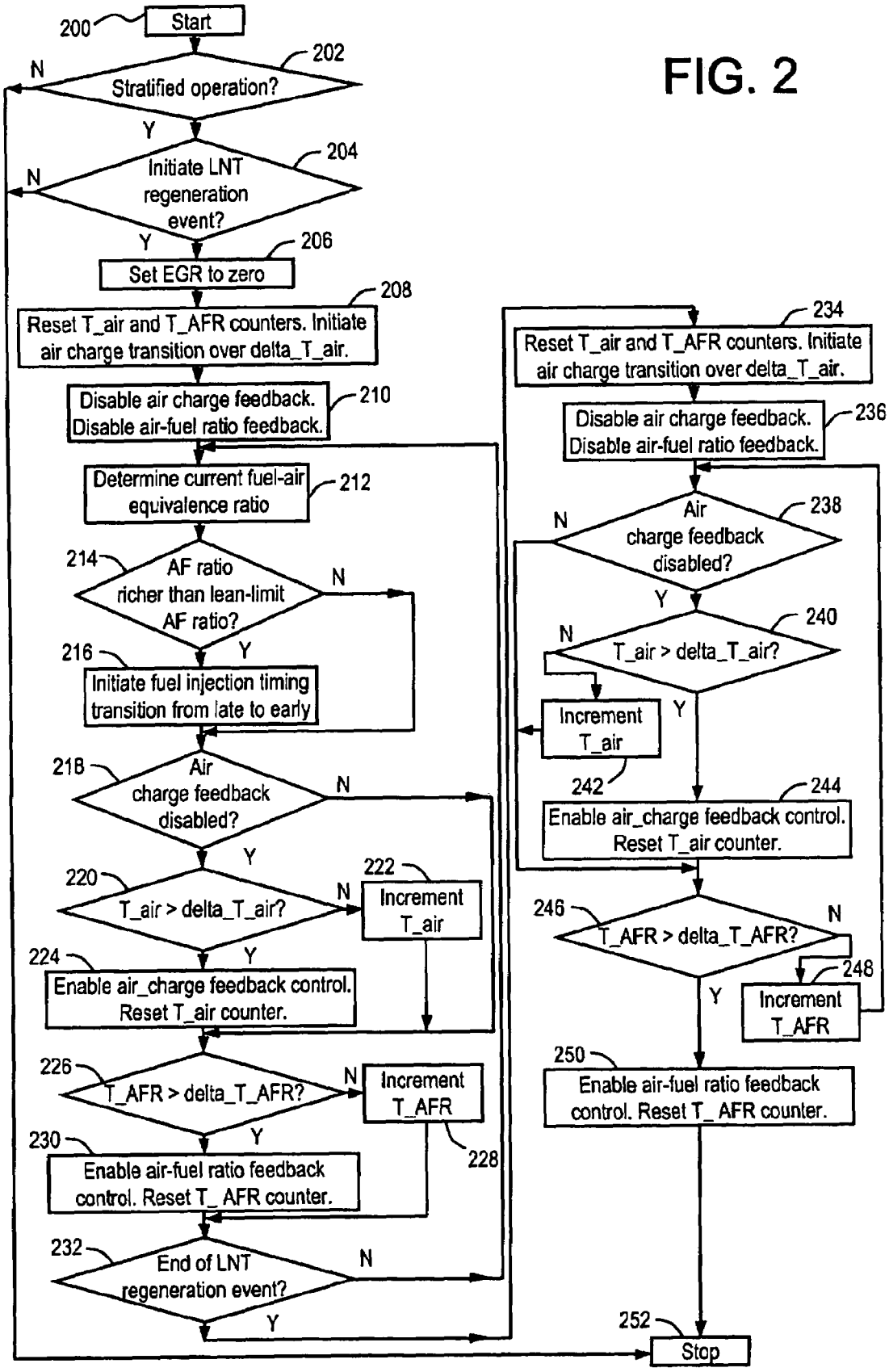
FIG. 2 is a computer flow chart illustrating a flow of operations for carrying out the engine control strategy during lean NOx trap regeneration in accordance with the invention.

Turning now to FIG. 2, a flowchart of a software routine 200 for performing the method for controlling a lean-burn direct-injection engine during lean NOx trap regeneration in accordance with the present invention is shown. This routine would be entered periodically from the main engine control software located in engine controller 30. Block 200 indicates generally the routine and the start of the routine for carrying out the present invention, which is performed in the inner control loop of a hierarchical torque-based engine control system with an overall torque command that must be maintained. The invention contemplates coordinated control of fuel, air, air-fuel ratio, exhaust gas recirculation (EGR), spark, swirl control valve, and fuel injection timing to enable smooth engine operation during lean NOx trap regeneration. At block 202, a determination is made as to whether or not the engine is operating in a stratified charge mode. If the engine is not operating in a stratified charge mode, the routine is exited at block 252.

If the engine is operating in a stratified charge mode, the routine proceeds to block 204, where a determination is made as to whether it is time to initiate an LNT regeneration event, for example as disclosed in commonly assigned, co-pending U.S. patent application Ser. No. 10/812,467. If the engine is not transitioning from stratified mode for the lean NOx trap regeneration transition, the routine is exited. If it is not time to initiate a regeneration event, then the routine is exited at block 252. If it is time to initiate a regeneration event, then the exhaust gas recirculation is set to zero at block 206.

The routine proceeds at block 208, wherein T_air and T_AFR counters are started (reset) and the air charge transition is initiated over the transition period delta_T_air. The quantities delta_T_air and delta_T_AFR denote the time intervals at the initiation and completion of a lean NOx trap regeneration event during which air charge and air fuel ratio feedback control, respectively, are disabled. The quantities T_air and T_AFR denote the counters that are used to monitor these time intervals.

At block 210, the air charge feedback and air-fuel ratio feedback controls are disabled. A determination of the current air-fuel equivalence ratio is made at block 212, and the determined current air-fuel ratio is compared to the lean limit air-fuel ratio at block 214.

At block 214, if the determined current air-fuel ratio is richer than the lean limit air-fuel ratio, then transition from lean stratified engine operation to rich homogenous engine operation is initiated at block 216 wherein the fuel injection timing transition from late to early is initiated. If the determined current air-fuel ratio is not greater than the lean limit air-fuel ratio, then the routine proceeds to block 218.

At block 218, a determination is made as to whether the air charge feedback control is disabled. If the air charge feedback control is disabled, then a determination is made as to whether T_air is greater than delta_T_air at block 220. If the air charge feedback control is not disabled at block 218, then routine proceeds to block 226.

At block 220, if T_air is greater than delta_T_air, then the air charge feedback control is enabled and the T_air counter is reset at block 224. If at block 220, T_air is not greater than delta_T_air, then the routine proceeds to block 222 wherein T_air is increased in increments until T_air is greater than delta_T_air, at which time the routine continues at block 224.

At block 226, a determination is made as to whether T_AFR is greater than delta_T_AFR. If T_AFR is greater than delta_T_AFR, then the air-fuel ratio feedback control is enabled and the T_AFR counter is reset at block 230. If T_AFR is not greater than delta_T_AFR, then the routine proceeds to block 228 wherein T_AFR is increased in increments until T_AFR is greater than delta_T_AFR, at which time the routine proceeds at block 232.

At block 232, a determination is made as to whether or not to end the LNT regeneration event, e.g. as disclosed in commonly assigned, co-pending U.S. patent application Ser. No. 10/812,467 and commonly assigned U.S. Pat. No. 6,293,092. If the determination is made to continue the LNT regeneration event, then the routine proceeds at block 212. If the determination is made to end the LNT regeneration event, then the T_air and T_AFR counters are reset and the air charge transition over delta_T_air is initiated at block 234. The air charge feedback controls and air-fuel ratio feedback controls are disabled at block 236.

At block 238, a determination is made as to whether or not the air charge feedback control is disabled. If the air charge feedback control is disabled, then the routine proceeds at block 240. If at block 238, a determination is made that the air charge feedback control is not disabled, then the routine proceeds at 246.

If the air charge feedback control is disabled, then the routine proceeds at block 240 wherein a determination is made as to whether T_air is greater than delta_T_air. If T_air is greater than delta_T_air, then the routine proceeds to block 244. If T_air is not greater than delta_T_air, then the routine proceeds to block 242 wherein T_air is increased in increments and the routine proceeds to block 246.

If at block 240, the determination is made that T_air is greater than delta_T_air, then the routine proceeds to block 244 wherein the air charge feedback control is enabled and the T_air counter is reset.

At block 246, a determination is made as to whether T_AFR is greater than delta_T_AFR. If T_AFR is greater than delta_T_AFR, then the air-fuel ratio feedback control is enabled and the T_AFR counter is reset at block 250 and the routine is exited at block 252. If T_AFR is not greater than delta_T_AFR, then T_AFR is increased in increments and the routine proceeds to block 238.

In accordance with the method, upon initiation of a lean NOx trap regeneration event, the switch to homogenous mode and early fuel injection timing is postponed until the air-fuel ratio has become richer than the lean limit air fuel ratio. The lean limit air-fuel ratio is defined as the air-fuel ratio that will provide an acceptable stability of operation. In one embodiment, coordinated control is further achieved by transitioning the desired air charge mass from an initial air charge mass to final air charge mass values at both transitions into and out of the lean NOx trap regeneration event over a time interval delta_T_air. The desired air charge mass following the transition into and out of the lean NOx trap regeneration event is adjusted from an initial air charge mass to a final air charge mass value over a pre-calibrated or an on-line estimated time interval. The air-fuel feedback control is disabled for a pre-calibrated or an on-line estimated period of time, delta_T_AFR, following the transition into and out of the lean NOx trap regeneration event. The air charge feedback control is disabled for a different period of time delta_T_air, which may comprise a pre-calibrated or an on-line estimated period of time, following the same transitions.

The desired EGR mass is set to zero. Fueling of the engine is determined by driver demand. Fueling may be further controlled in accordance with the teaching of commonly assigned, co-pending U.S. patent application Ser. No. 10/812,466 to compensate for loss in torque due to additional pumping work during the lean NOx trap regeneration event.

Figure 3:
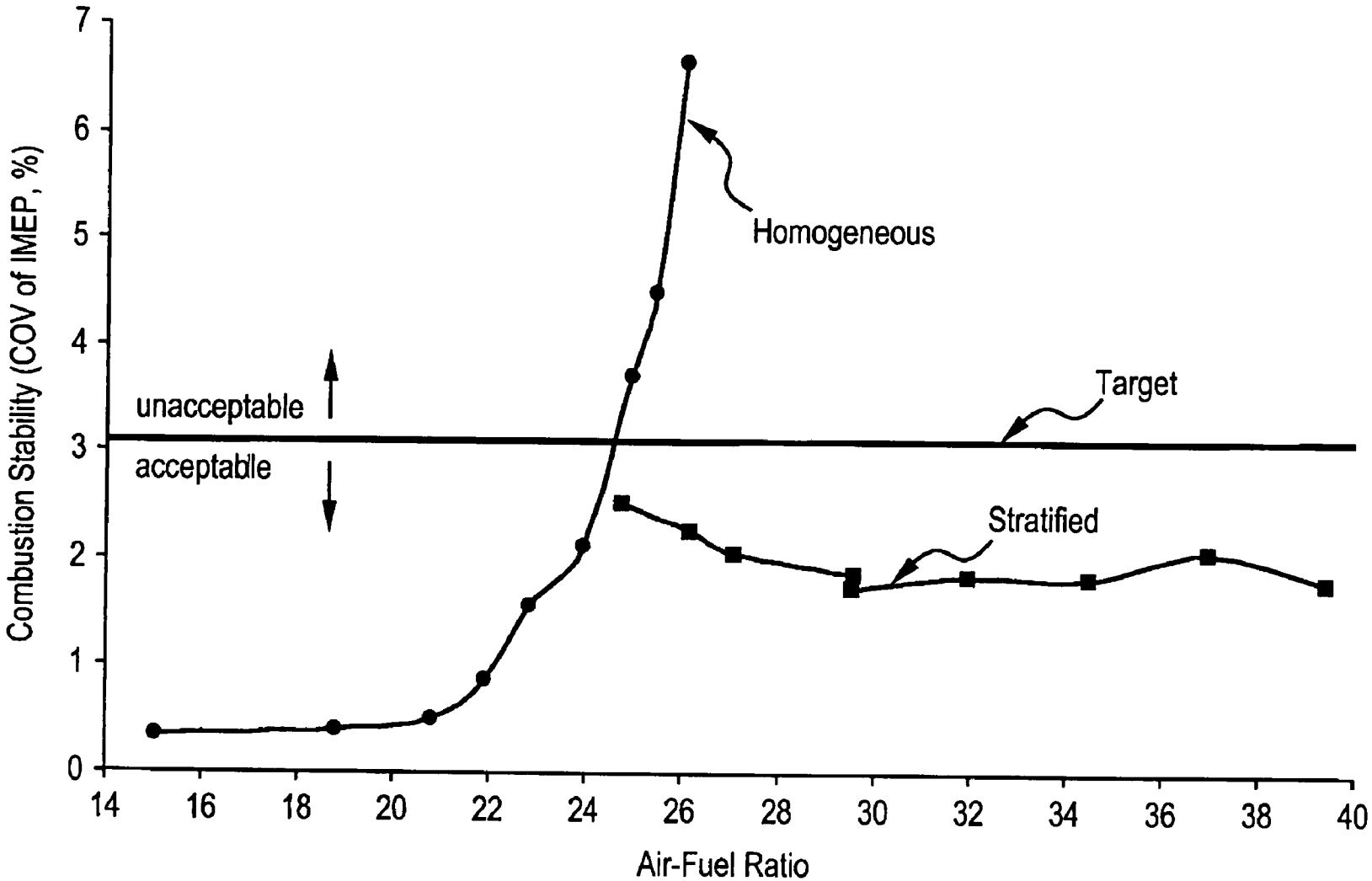
FIG. 3 is a graph illustrating combustion stability versus air-fuel ratio for homogeneous and stratified modes of operation.

FIG. 3 provides a graph illustrating combustion stability as a coefficient of variation of indicated mean effective pressure (COV of IMEP, %) versus air-fuel ratio. Homogenous operation is illustrated by line H for a premixed, lean intake mixture with a swirl index (SI) of 3.3 at 45° C. Stratified operation is illustrated by line S for a stratified, lean intake mixture with exhaust gas recirculation (EGR) with an SI of 1.9 at 95° C. A target stable combustion is illustrated by line T. It can be seen that uncontrolled transition from stratified mode to homogenous mode during regeneration may result in unacceptable combustion stability (i.e. high COV of IMEP) without the present coordinated engine control.

Figure 4:
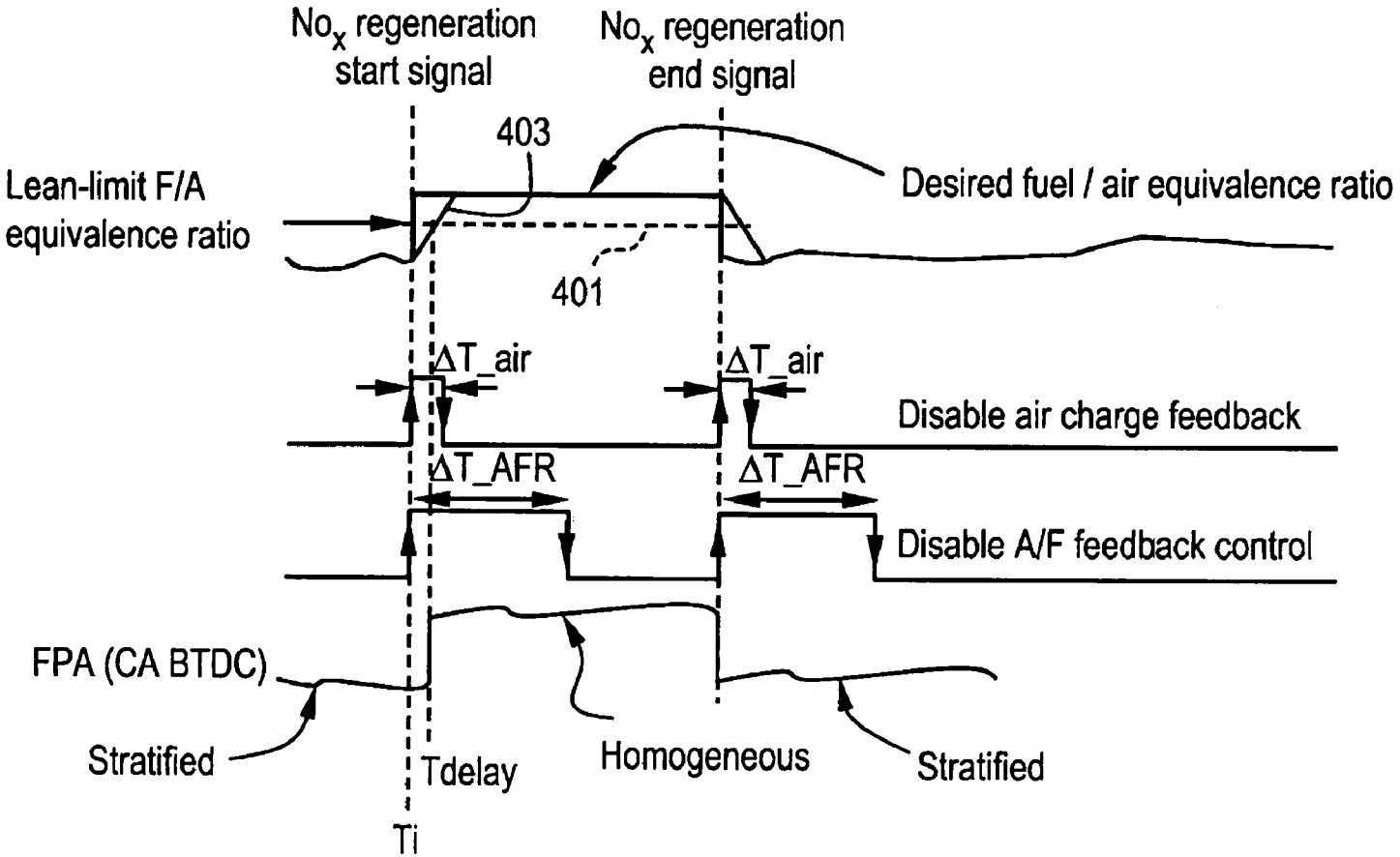
FIG. 4 is a diagram illustrating delaying the transition from lean stratified engine operation to rich homogenous engine operation until the determined air-fuel ratio. reaches the lean limit air-fuel ratio in accordance with the invention.

FIG. 4 illustrates the lean limit fuel-air equivalence ratio and fuel injection timing in accordance with the invention. FIG. 4 also indicates the disabling of air charge and air-fuel ratio feedback control for a period of time following the transition into and out of the lean NOx trap regeneration event at time Ti. The time intervals delta_T_air and delta_T_AFR, respectively, are described above and illustrated by the flow chart in FIG. 2. Upon transitioning from lean stratified to rich homogeneous mode at Ti, the switch to early fuel injection timing is delayed to a time, Tdelay, determined by the air-fuel ratio becoming richer than the lean limit air-fuel ratio. In the uppermost plot of FIG. 4, the lean limit fuel/air equivalence ratio is indicated by broken line 401. When the measured estimate of fuel/air equivalence ratio, indicated by the ramped line 403, exceeds the lean limit fuel/air equivalence ratio, the transition from late to early fuel injection timing is initiated (time Tdelay). By delaying the transition from lean stratified engine operation to rich homogenous engine operation until the determined air-fuel ratio reaches the lean limit air-fuel ratio, the combustion stability is improved resulting in smooth engine operation during the lean NOx trap regeneration.

Figure 5:
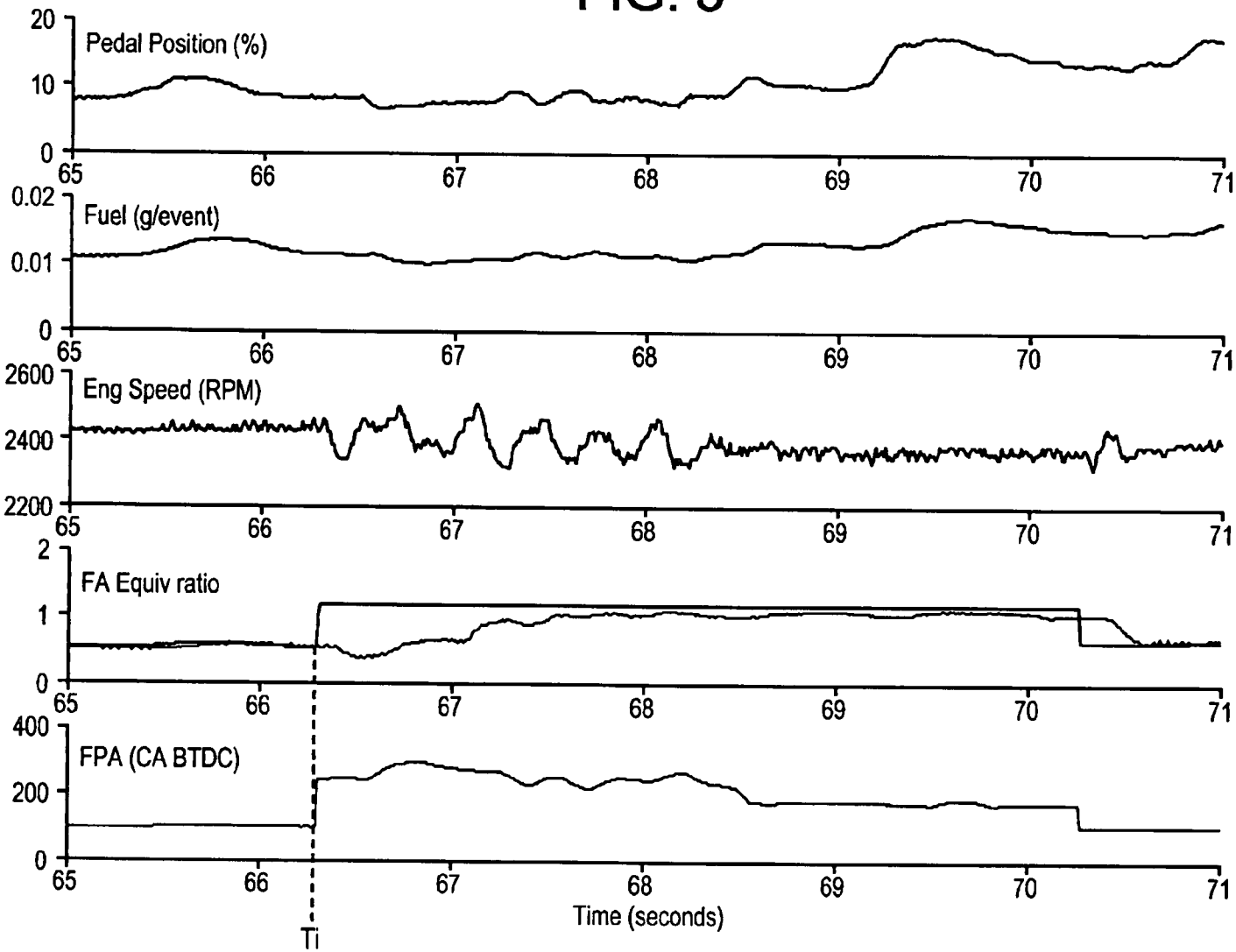
FIG. 5 is a graph illustrating a lean NOx trap regeneration event without coordinated engine control; and, FIG. 6 is a graph illustrating a lean NOx trap regeneration event with coordinated engine control in accordance with the invention.
Figure 6:
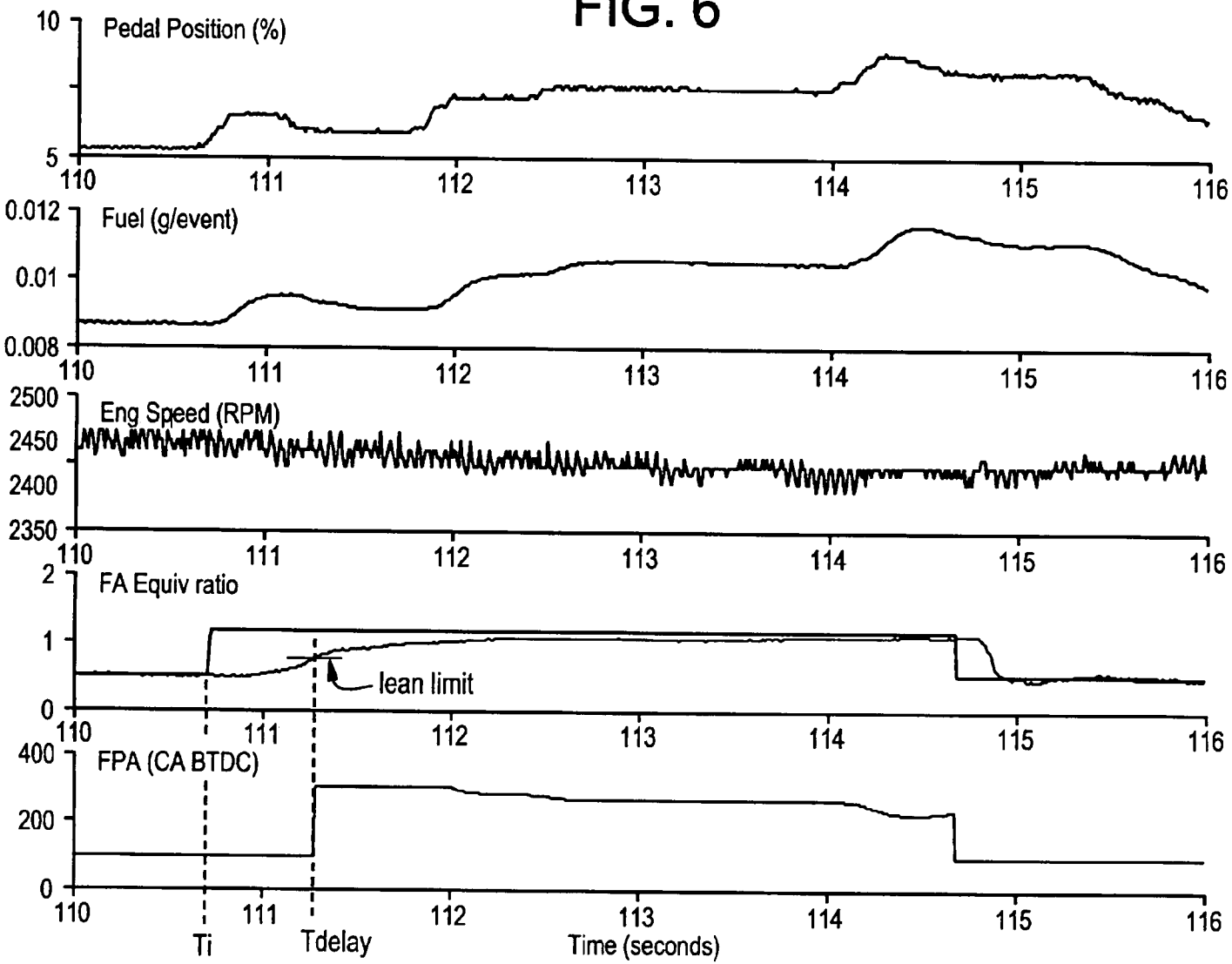

FIGS. 5 and 6 provide lean NOx trap vehicle test operation results during lean NOx trap regeneration without the present coordinated engine control (FIG. 5) and with the coordinated engine control method of the present invention (FIG. 6). Here, fuel pulse angle (FPA) indicates fuel injection timing, expressed in degrees of crank angle, before top dead center (CA BTDC). The results provide in-vehicle data with the vehicle driven at 70 kph in 4th gear. In FIG. 5, a lean NOx trap regeneration event is initiated at approximately 66.3 seconds (time Ti). The fuel injection timing is synchronously transitioned from late to early injection in this case. As indicated by the engine speed's oscillatory behavior, this type of control leads to unacceptable engine response. In FIG. 6, the vehicle is operating under the same conditions as in FIG. 5. In FIG. 6, upon initiation of the lean NOx trap regeneration event at 110.7 seconds (time Ti), the engine is controlled in a coordinated fashion as per this invention. The fuel injection timing transition from late to early is delayed up to the point where the fuel-air equivalence ratio exceeds the lean-limit fuel-air equivalence ratio (time Tdelay). Control of other engine variables is coordinated as well in accordance with the invention. The present coordinated control results in smooth engine behavior as exemplified by the steady engine speed signal.

Advantageously, there is a marked improvement in terms of smooth engine operation during the lean NOx trap regeneration event due to the method described in this invention. Misfires and partial burns during mixed-mode transitions are prevented due to extra-lean operation under early injection conditions. This results in improved driveability and reduced emissions.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. Method for controlling a direct-injection gasoline engine during regeneration of a lean NOx trap disposed in an exhaust path of the engine, the regeneration characterized by a transition from lean stratified engine operation to rich homogeneous engine operation, comprising:

upon initiation of a lean NOx trap regeneration event, determining a current air-fuel ratio and comparing the current air-fuel ratio to a lean limit air-fuel ratio;

delaying the transition from lean stratified engine operation to rich homogeneous engine operation until the current air-fuel ratio reaches the lean limit air-fuel ratio;

initiating transition from lean stratified engine operation to rich homogeneous engine operation when the current air-fuel ratio reaches the lean limit air-fuel ratio; and disabling an air-fuel feedback control for a period of time following the transition into and out of the lean NOx trap regeneration event.

2. The method of claim 1, wherein the period of time for disabling the air-fuel feedback control comprises a pre-calibrated period of time.

3. The method of claim 1, wherein the period of time for disabling the air-fuel feedback control comprises an on-line estimated period of time.

4. The method of claim 1, further comprising:

controlling engine torque based upon driver demand.

5. Method for controlling a direct-injection gasoline engine during regeneration of a lean NOx trap disposed in an exhaust path of the engine, the regeneration characterized by a transition from lean stratified engine operation to rich homogeneous engine operation, comprising:

upon initiation of a lean NOx trap regeneration event, determining a current air-fuel ratio and comparing the current air-fuel ratio to a lean limit air-fuel ratio;

delaying the transition from lean stratified engine operation to rich homogeneous engine operation until the current air-fuel ratio reaches the lean limit air-fuel ratio;

initiating transition from lean stratified engine operation to rich homogeneous engine operation when the current air-fuel ratio reaches the lean limit air-fuel ratio; and disabling an air charge feedback control for a period of time following the transition into and out of a lean NOx trap regeneration event.

6. The method of claim 5, wherein the period of time for disabling the air charge feedback control comprises a pre-calibrated period of time.

7. The method of claim 5, wherein the period of time for disabling the air charge feedback control comprises an on-line estimated period of time.

8. Method for controlling a direct-injection gasoline engine during regeneration of a lean NOx trap disposed in an exhaust path of the engine, the regeneration characterized by a transition from lean stratified engine operation to rich homogeneous engine operation, comprising:

upon initiation of a lean NOx trap regeneration event, determining a current air-fuel ratio and comparing the current air-fuel ratio to a lean limit air-fuel ratio;

delaying the transition from lean stratified engine operation to rich homogeneous engine operation until the current air-fuel ratio reaches the lean limit air-fuel ratio;

initiating transition from lean stratified engine operation to rich homogeneous engine operation when the current air-fuel ratio reaches the lean limit air-fuel ratio; and adjusting a desired air charge mass following the transition into and out of the lean NOx trap regeneration event from an initial air charge mass value to a final air charge mass value over one of a pre-calibrated time interval and an on-line estimated time interval.

9. Method for controlling a direct-injection gasoline engine during regeneration of a lean NOx trap disposed in an exhaust path of the engine, the regeneration characterized by a transition from lean stratified engine operation to rich homogeneous engine operation, comprising:

upon initiation of a lean NOx trap regeneration event, determining a current air-fuel ratio and comparing the current air-fuel ratio to a lean limit air-fuel ratio;

delaying the transition from lean stratified engine operation to rich homogeneous engine operation until the current air-fuel ratio reaches the lean limit air-fuel ratio;

initiating transition from lean stratified engine operation to rich homogeneous engine operation when the current air-fuel ratio reaches the lean limit air-fuel ratio; and setting the desired exhaust gas recirculation mass to zero.

10. System for controlling a direct-injection gasoline engine during regeneration of a lean NOx trap disposed in an exhaust path of the engine, the regeneration characterized by a transition from lean stratified engine operation to rich homogeneous engine operation, comprising:

means for determining a current air-fuel ratio and comparing the current air-fuel ratio to a lean limit air-fuel ratio upon initiation of a lean NOx trap regeneration event;

means for delaying the transition from lean stratified engine operation to rich homogeneous engine operation until the current air-fuel ratio reaches the lean limit air-fuel ratio;

means for initiating transition from lean stratified engine operation to rich homogeneous engine operation when the current air-fuel ratio reaches the lean limit air-fuel ratio; and means for disabling an air-fuel feedback control for a period of time following the transition into and out of the lean NOx trap regeneration event.

11. The system of claim 10, wherein said period of time for disabling the air-fuel feedback control comprises a pre-calibrated period of time.

12. The system of claim 10, wherein said period of time for disabling the air-fuel feedback control comprises an on-line estimated period of time.

13. The system of claim 10 further comprising:

means for controlling engine torque based upon driver demand.

14. System for controlling a direct-injection gasoline engine during regeneration of a lean NOx trap disposed in an exhaust path of the engine, the regeneration characterized by a transition from lean stratified engine operation to rich homogeneous engine operation, comprising:

means for determining a current air-fuel ratio and comparing the current air-fuel ratio to a lean limit air-fuel ratio upon initiation of a lean NOx trap regeneration event;

means for delaying the transition from lean stratified engine operation to rich homogeneous engine operation until the current air-fuel ratio reaches the lean limit air-fuel ratio;

means for initiating transition from lean stratified engine operation to rich homogeneous engine operation when the current air-fuel ratio reaches the lean limit air-fuel ratio; and means for disabling an air charge feedback control for a period of time following the transition into and out of the lean NOx trap regeneration event.

15. The system of claim 14, wherein said period of time for disabling the air charge feedback control comprises a pre-calibrated period of time.

16. The system of claim 14, wherein said period of time for disabling the air charge feedback control comprises an on-line estimated period of time.

17. System for controlling a direct-injection gasoline engine during regeneration of a lean NOx trap disposed in an exhaust path of the engine, the regeneration characterized by a transition from lean stratified engine cooperation to rich homogeneous engine operation, comprising:

means for determining a current air-fuel ratio and comparing the current air-fuel ratio to a lean limit air-fuel ratio upon initiation of a lean NOx trap regeneration event;

means for delaying the transition from lean stratified engine operation to rich homogeneous engine operation until the current air-fuel ratio reaches the lean limit air-fuel ratio;

means for initiating transition from lean stratified engine operation to rich homogeneous engine operation when the current air-fuel ratio reaches the lean limit air-fuel ratio; and means for adjusting a desired air charge mass following the transition into and out of the lean NOx trap regeneration event from an initial air charge mass value to a final air charge mass value over one of a pre-calibrated time interval and an on-line estimated time interval.

18. System for controlling a direct-injection gasoline engine during regeneration of a lean NOx trap disposed in an exhaust path of the engine, the regeneration characterized by a transition from lean stratified engine operation to rich homogeneous engine operation, comprising:

means for determining a current air-fuel ratio and comparing the current air-fuel ratio to a lean limit air-fuel ratio upon initiation of a lean NOx trap regeneration event;

means for delaying the transition from lean stratified engine operation to rich homogeneous engine operation until the current air-fuel ratio reaches the lean limit air-fuel ratio;

means for initiating transition from lean stratified engine operation to rich homogeneous engine operation when the current air-fuel ratio reaches the lean limit air-fuel ratio; and means for setting a desired exhaust gas recirculation mass to zero.

19. Article of manufacture comprising a storage medium having a computer program encoded therein for effecting a method for controlling a direct-injection gasoline engine during regeneration of a lean NOx trap disposed in an exhaust path of the engine, the regeneration characterized by a transition from lean stratified engine operation to rich homogeneous engine operation, the program comprising:

code for comparing a current air-fuel ratio to a lean limit air-fuel ratio upon initiation of a lean NOx trap regeneration event;

code for delaying transition from lean stratified engine operation to rich homogeneous engine operation until the current air-fuel ratio reaches the lean limit air-fuel ratio;

code for initiating transition from lean stratified engine operation to rich homogeneous engine operation when the current air-fuel ratio reaches the lean limit air-fuel ratio; and code for disabling an air-fuel feedback control for a period of time following the transition into and out of the lean NOx trap regeneration event.

20. The article of claim 19, wherein said period of time for disabling the air-fuel feedback control comprises a pre-calibrated period of time.

21. The article of claim 19, wherein said period of time for disabling the air-fuel feedback control comprises an on-line estimated period of time.

22. The article of claim 19 further comprising:

code on for controlling engine torque based upon driver demand.

23. Article of manufacture comprising a storage medium having a computer program encoded therein for effecting a method for controlling a direct-injection gasoline engine during regeneration of a lean NOx trap disposed in an exhaust path of the engine, the regeneration characterized by a transition from lean stratified engine operation to rich homogeneous engine operation, the program comprising:

code for comparing a current air-fuel ratio to a lean limit air-fuel ratio upon initiation of a lean NOx trap regeneration event;

code for delaying transition from lean stratified engine operation to rich homogeneous engine operation until the current air-fuel ratio reaches the lean limit air-fuel ratio;

code for initiating transition from lean stratified engine operation to rich homogeneous engine operation when the current air-fuel ratio reaches the lean limit air-fuel ratio; and code for disabling an air charge feedback control for a period of time following the transition into and out of the lean NOx trap regeneration event.

24. The article of claim 23, wherein said period of time for disabling the air charge feedback control comprises a pre-calibrated period of time.

25. The article of claim 23, wherein said period of time for disabling the air charge feedback control comprises an on-line estimated period of time.

26. Article of manufacture comprising a storage medium having a computer program encoded therein for effecting a method for controlling a direct-injection gasoline engine during regeneration of a lean NOx trap disposed in an exhaust path of the engine, the regeneration characterized by a transition from lean stratified engine operation to rich homogeneous engine operation, the program comprising:

code for comparing a current air-fuel ratio to a lean limit air-fuel ratio upon initiation of a lean NOx trap regeneration event;

code for delaying transition from lean stratified engine operation to rich homogeneous engine operation until the current air-fuel ratio reaches the lean limit air-fuel ratio;

code for initiating transition from lean stratified engine operation to rich homogeneous engine operation when the current air-fuel ratio reaches the lean limit air-fuel ratio; and code for adjusting a desired air charge mass following transition into and out of the lean NOx trap regeneration event from an initial air charge mass to a final air charge mass value over one of a pre-calibrated time interval and an on-line estimated time interval.

27. Article of manufacture comprising a storage medium having a computer program encoded therein for effecting a method for controlling a direct-injection gasoline engine during regeneration of a lean NOx trap disposed in an exhaust path of the engine, the regeneration characterized by a transition from lean stratified engine operation to rich homogeneous engine operation, the program comprising:

code for comparing a current air-fuel ratio to a lean limit air-fuel ratio upon initiation of a lean NOx trap regeneration event;

code for delaying transition from lean stratified engine operation to rich homogeneous engine operation until the current air-fuel ratio reaches the lean limit air-fuel ratio;

code for initiating transition from lean stratified engine operation to rich homogeneous engine operation when the current air-fuel ratio reaches the lean limit air-fuel ratio; and code for setting a desired exhaust gas recirculation mass to zero.

* * * * *